US008224194B2

(12) United States Patent
Maruyama

(10) Patent No.: US 8,224,194 B2
(45) Date of Patent: Jul. 17, 2012

(54) IMAGE FORMING APPARATUS DISCHARGING STAYING TONER

(75) Inventor: Yoshinori Maruyama, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 480 days.

(21) Appl. No.: 12/467,593

(22) Filed: May 18, 2009

(65) Prior Publication Data

US 2009/0290885 A1 Nov. 26, 2009

(30) Foreign Application Priority Data

May 26, 2008 (JP) ..... 2008-136753

(51) Int. Cl.
*G03G 15/08* (2006.01)

(52) U.S. Cl. ..... 399/29; 399/257

(58) Field of Classification Search ..... 399/27, 399/29, 61, 257
See application file for complete search history.

(56) References Cited

U.S. PATENT DOCUMENTS

| | | | | |
|---|---|---|---|---|
| 5,162,849 | A * | 11/1992 | Yoshino et al. | 399/29 |
| 6,766,121 | B2 * | 7/2004 | Nonaka et al. | 399/24 |
| 7,095,966 | B2 * | 8/2006 | Adachi | 399/27 |
| 7,269,364 | B2 * | 9/2007 | Tanaka et al. | 399/27 |
| 7,356,289 | B2 * | 4/2008 | Itagaki et al. | 399/257 |
| 7,630,656 | B2 * | 12/2009 | Endou et al. | 399/29 |
| 7,756,436 | B2 * | 7/2010 | Yamane | 399/71 |
| 2003/0197876 | A1 | 10/2003 | Oshima | |
| 2005/0025506 | A1 | 2/2005 | Adachi | |
| 2007/0253742 | A1 * | 11/2007 | Maeshima et al. | 399/257 |
| 2008/0075481 | A1 | 3/2008 | Sugaya | |

FOREIGN PATENT DOCUMENTS

| | | |
|---|---|---|
| JP | 2000-158763 | 6/2000 |
| JP | 2004-125829 A | 4/2004 |
| JP | 2005-062840 | 3/2005 |
| JP | 2005-262709 | 9/2005 |
| JP | 2008-077015 | 4/2008 |
| JP | 2008-107813 | 5/2008 |

OTHER PUBLICATIONS

Notice of Grounds of Rejection issued in the corresponding Japanese Patent Application No. 2008-136753 dated Apr. 20, 2010, and an English Translation thereof.

* cited by examiner

*Primary Examiner* — Robert Beatty
(74) *Attorney, Agent, or Firm* — Buchanan Ingersoll & Rooney PC

(57) ABSTRACT

An image forming apparatus calculates the amount of staying toner based on the amount of drive of the developer roller and the amount of toner consumed for a print job performed. When the amount of staying toner exceeds a threshold, the toner is discharged. The threshold used upon completion of image stabilization is larger than that used upon completion of a print job. Even when performing image stabilization temporarily increases the amount of staying toner in the developing device, immediate toner discharge based on that condition is prevented. Thus, toner consumption can be minimized.

27 Claims, 12 Drawing Sheets

(A) AMOUNTS OF STAYING TONER FOR JOB

| | |
|---|---|
| Y | 10 |
| M | 3 |
| C | −5 |
| K | 2 |

(B) CURRENT AMOUNTS OF STAYING TONER IN PRINTERS

| | No.1 | No.2 | No.3 |
|---|---|---|---|
| Y | 3 | 0 | 2 |
| M | 0 | 5 | 8 |
| C | 0 | 5 | 8 |
| K | 6 | 9 | 4 |

FIG.16

(A) AMOUNTS OF STAYING TONER WHEN NO.1 PRINTS

| | No.1 | No.2 | No.3 |
|---|---|---|---|
| Y | 13 | 0 | 2 |
| M | 3 | 5 | 8 |
| C | −5→0 | 5 | 8 |
| K | 8 | 9 | 4 |

MAX : Y IN NO.1 = 13

NEGATIVE BECOMES ZERO (B) AMOUNTS OF STAYING TONER WHEN NO.2 PRINTS

| | No.1 | No.2 | No.3 |
|---|---|---|---|
| Y | 3 | 10 | 2 |
| M | 0 | 8 | 8 |
| C | 0 | 0 | 8 |
| K | 6 | 11 | 4 |

MAX : K IN NO.2 = 11

(C) AMOUNTS OF STAYING TONER WHEN NO.3 PRINTS

| | No.1 | No.2 | No.3 |
|---|---|---|---|
| Y | 3 | 0 | 12 |
| M | 0 | 5 | 11 |
| C | 0 | 5 | 3 |
| K | 6 | 9 | 6 |

MAX : Y IN NO.3 = 12

IN THIS EXAMPLE, MAXIMUM CAN BE MINIMIZED MOST EFFECTIVELY IN GENERAL IF NO.2 PRINTS, AND THUS NO.2 IS SELECTED FOR PRINTING

IMAGE FORMING APPARATUS DISCHARGING STAYING TONER

This application is based on Japanese Patent Application No. 2008-136753 filed with the Japan Patent Office on May 26, 2008, the entire content of which is hereby incorporated by reference.

BACKGROUND OF THE INVENTION

1. Field of the Invention

The present invention relates to an image forming apparatus, and more particularly to an image forming apparatus discharging staying toner.

2. Description of the Related Art

Electrophotographic image forming apparatus (such as multi-function peripherals (MFPs), facsimile devices, copiers and printers) incorporate a developing device for performing development using toner.

Document 1, specified below, discloses an image forming apparatus that counts the number of rotations of the developer roller and the number of dots in images created on the photoreceptor drum in order to minimize the decrease of image quality due to deterioration of toner. It performs a development process using a developer (i.e. it discharges staying toner) if the number of dots in the images for a prescribed number of rotations of the developer roller is smaller than a predetermined threshold.

[Document 1] JP 2004-125829 A

Image forming apparatus that discharge the staying toner when the staying toner exceeds a predetermined amount may consume toner unnecessarily. It can be explained as follows:

If the dot count for the image that will be printed immediately after the staying toner exceeds a predetermined amount is relatively high (i.e. the image consumes a relatively large amount of toner), printing that image may result in an amount of staying toner smaller than the predetermined value. Even when this is the case, a conventional image forming apparatus discharges the staying toner when the staying toner exceeds the predetermined amount, which means that it may discharge staying toner that does not have to be discharged.

Further, an image forming apparatus performs image stabilization in order to keep producing proper images. It uses the developing device to print a pattern, which is then detected and used for positioning of images and for density control.

Performing image stabilization results in an increased amount of staying toner. If the staying toner is discharged each time an image stabilization process is performed following a power-on, toner is consumed even when no printing is performed.

Image stabilization may be performed while printing is interrupted, and an image with a relatively large toner consumption may be printed directly after the interruption, in which case the staying toner would not have to be discharged after the image stabilization.

SUMMARY OF THE INVENTION

The present invention was made to solve the above problems. The object of the present invention is to provide an image forming apparatus, a method of controlling an image forming apparatus and a program for controlling an image forming apparatus where toner consumption can be minimized.

To achieve the above object, according to an aspect of the present invention, an image forming apparatus includes: a developing device for containing toner and performing development using toner; a print performing unit that performs printing using toner; an image stabilization unit that performs an image stabilization process using toner; an acquiring unit that acquires the amount of staying toner in the developing device; and a toner discharge unit that, upon completion of printing, discharges toner depending on the amount of staying toner acquired by the acquiring unit and a first reference or, upon completion of an image stabilization process, discharges toner depending on the amount of staying toner acquired by the acquiring unit and a second reference.

According to the invention, an image forming apparatus, a method of controlling an image forming apparatus and a program for controlling an image forming apparatus where toner consumption can be minimized is provided.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 16 shows the resulting amounts of remaining toner in each of printers No. 1 to No. 3 when each of these printers performs the job represented by (A) in FIG. 15.

DESCRIPTION OF THE PREFERRED EMBODIMENTS

First Embodiment

Figure 1:
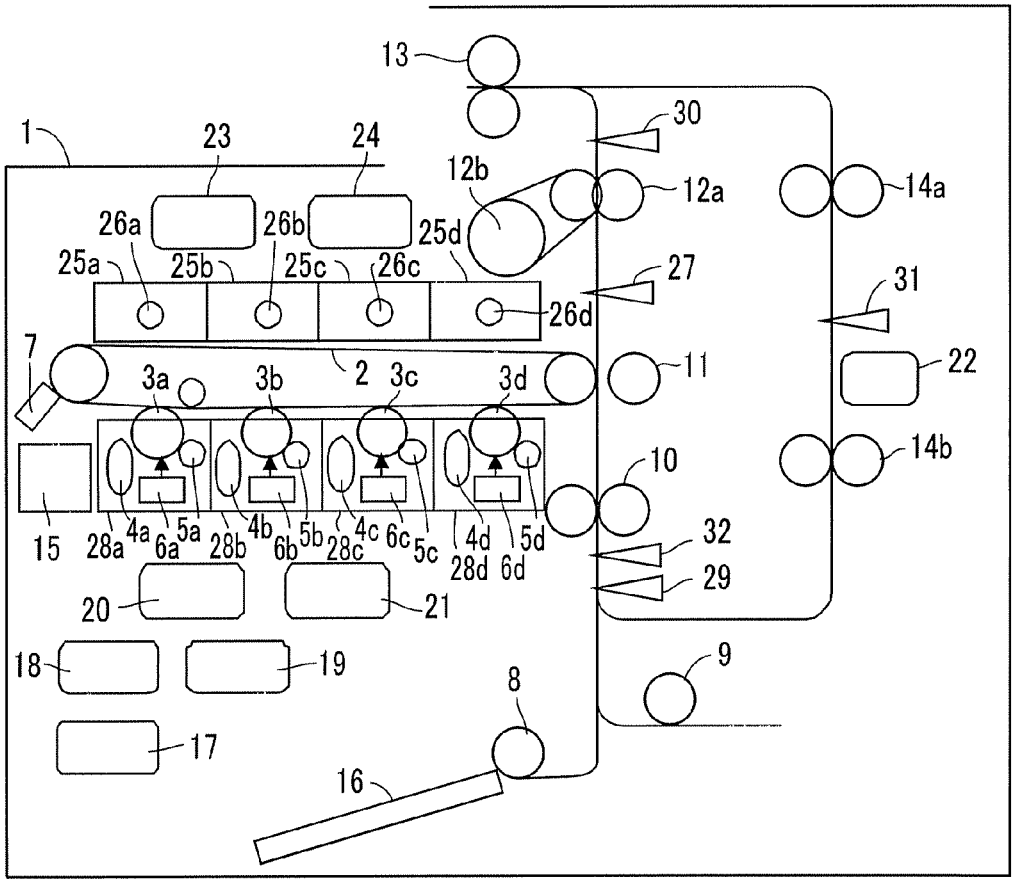
FIG. 1 is a schematic center section of an image forming apparatus according to a first embodiment of the present invention.

Referring to FIG. 1, an image forming apparatus is a tandem full color printer.

First, the configuration of the imaging unit of the image forming apparatus will be described. Image forming apparatus 1 incorporates cartridges 28*a*, 28*b*, 28*c* and 28*d* corresponding to Y, M, C and K (yellow, magenta, cyan and black). Cartridges 28*a*, 28*b*, 28*c* and 28*d* incorporate electrifying units 5*a*, 5*b*, 5*c* and 5*d*, respectively, which electrify photoreceptors 3*a*, 3*b*, 3*c* and 3*d*, respectively, exposure emits 6*a*, 6*b*, 6*c* and 6*d*, respectively, for performing exposure to create image patterns, and developing devices 4*a*, 4*b*, 4*c* and 4*d*, respectively, for performing development using toner.

The image forming apparatus includes: an intermediate transfer belt 2 for forming an image by superimposing, upon each other, four toner images in different colors formed on photoreceptors 3*a*, 3*b*, 3*c* and 3*d*; secondary transfer roller 11 for transferring a toner image formed on intermediate transfer belt 2 onto recording media; an intermediate transfer belt cleaner (blade) 7 for removing toner remaining on intermediate transfer belt 2 after transfer; waste toner box 15 for containing removed toner remaining after transfer; toner bottles 25*a*, 25*b*, 25*c* and 25*d* that supply toner to cartridges 28*a*, 28*b*, 28*c* and 28*d*, respectively, by driving stirring blades 26*a*, 26*b*, 26*c* and 26*d*.

Next, the configuration of the transport unit for recording media will be described. The image forming apparatus includes: a feed roller 8 for feeding recording media from a recording media container unit 16; timing rollers 10 for temporarily stopping recording media that have been fed; secondary transfer roller 11 for transferring a toner image formed on intermediate transfer belt 2 onto recording media; fixing rollers 12 (consisting of a pressurizing roller 12*a* and a heating roller 12*b*) for fixing a toner image transferred onto recording media; discharge rollers 13 for discharging recording media after fixing or for transporting them to a duplex transport path; and duplex path transport rollers 14*a* and 14*b* for transporting recording media to timing rollers 10 via the duplex transport path.

On the feeding path, a paper detection sensor (paper warp sensor or warp detection sensor) 27 is provided between secondary transfer roller 11 and fixing rollers 12 for determining if a sheet warp formed by the transfer location close to secondary transfer roller 11 and fixing rollers 12 has reached a predetermined extent.

Feed roller 8 is a feed roller for the standard cassette. The feeding path also has a feed roller for multiple manual feeding 9.

Inside the image forming apparatus are provided motors, including a color PC (Photo-Conductor) motor 17, a main motor 18, a fixing motor 19, a color development motor 20, a development motor 21, a duplex path transport motor 22, a toner supply motor (for yellow and magenta) 23, and a toner supply motor (for cyan and black) 24.

In addition, paper detection sensors 29 to 31 and paper material detection sensor 32 are provided on the feeding path. Paper material detection sensor 32 may be omitted.

Figure 2:
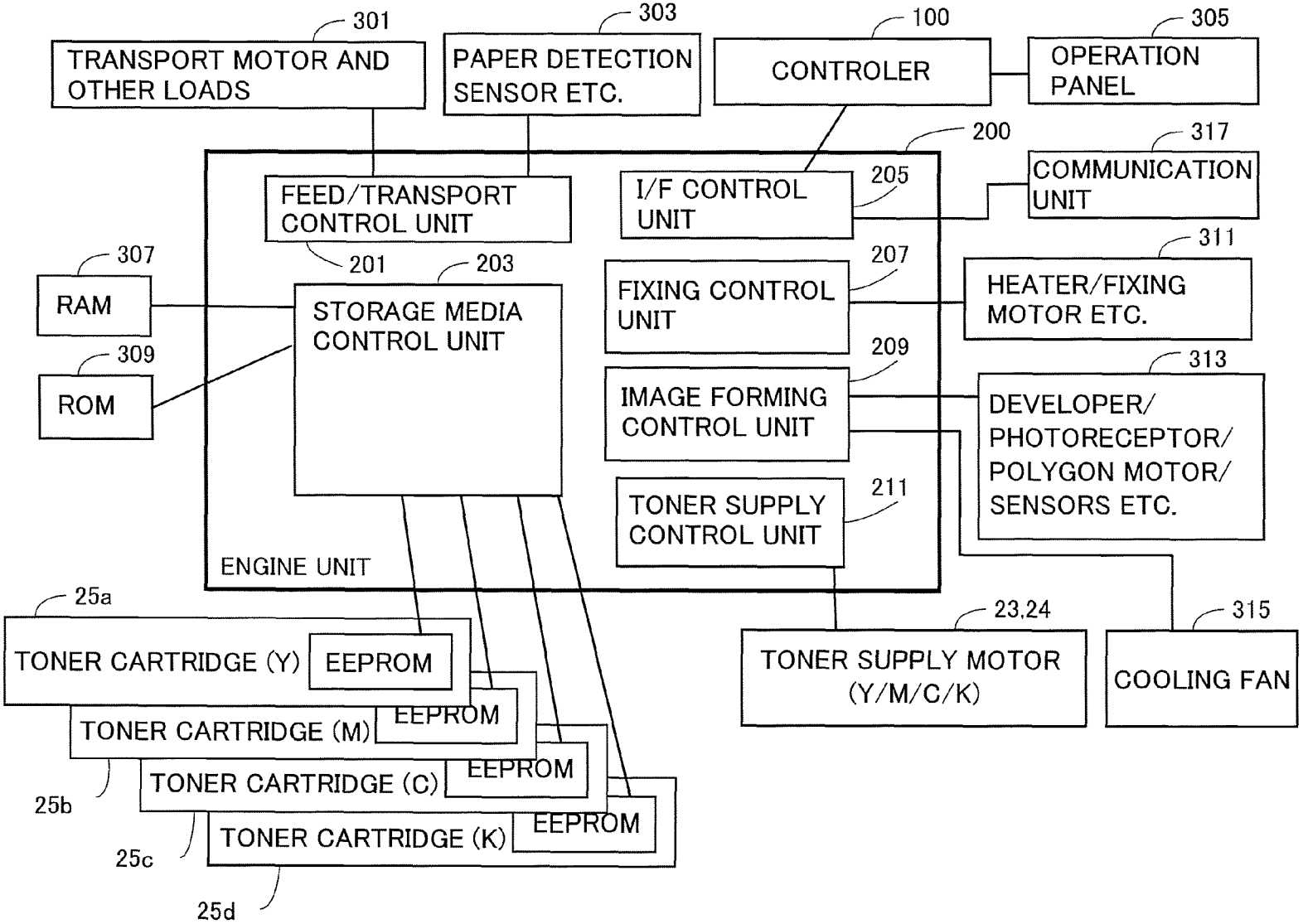
FIG. 2 is a block diagram showing the configuration of image forming apparatus 1.

FIG. 2 is a block diagram showing the configuration of image forming apparatus 1. The image forming apparatus includes an engine unit 200. Engine unit 200 includes: a feed/transport control unit 201; a storage media control unit 203; an I/F control unit 205; a fixing control unit 207; an image forming control unit 209; and a toner supply control unit 211 (these control units are implemented by a CPU).

Feed/transport control unit 201 is connected to a transport motor and other loads 301 as well as to paper detection sensor and the like 303 to control feed and transport of paper.

Storage media control unit 203 is connected to EEPROMs (nonvolatile memories), which are storage media inside toner cartridges (toner bottles) for different colors 25*a* to 25*d*, and are capable of storing data from computations by the CPU and other information. Storage media control unit 203 is also connected to a RAM 307 and a ROM 309.

I/F control unit 205 is connected to controller unit 100 to exchange various information. An operation panel 305 is connected to controller unit 100. The user can use operation panel 305 to provide various settings.

Fixing control unit 207 is connected to a heater, fixing motor and the like 311 to control various devices for performing fixing processes.

Image forming control unit 209 is connected to members 313 such as a developing device (developing unit), a photoreceptor, a polygon motor, various sensors, a pressure joining/releasing clutch and an intermediate transport motor to control various devices for performing processes such as development and transfer. Image forming control unit 209 is also connected to a cooling fan 315 provided to cool the inside of the machine. Image forming control unit 209 controls cooling fan 315 to reduce increase in temperature inside the machine.

Toner supply control unit 211 is connected to toner supply motors 23 and 24. Toner supply control unit 211 follows print instructions and controls various devices so that toner of different colors can be supplied.

In addition, a communication unit 317 is connected to I/F control unit 205 to communicate with external devices via communication lines such as a network.

Figure 3:
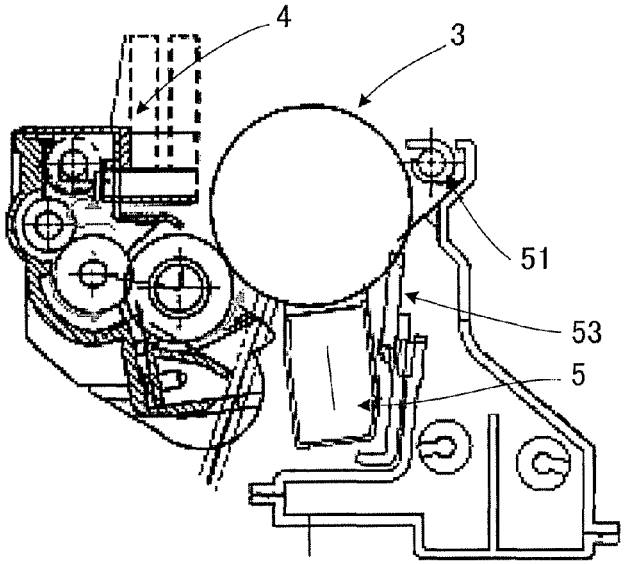
FIG. 3 is a sectional view showing the configuration of photoreceptor 3 and its surrounding components.

FIG. 3 is a sectional view showing the configuration of photoreceptor 3 and its surrounding components. Photoreceptor 3 is any one of photoreceptors 3*a*, 3*b*, 3*c* and 3*d*. An electrifying unit 5, a developing device (developing unit) 4, an eraser 51 and a cleaner 53 are positioned around photoreceptor 3.

Development consumes toner in developing device 4, which is then supplied with the same amount of toner that was consumed in toner bottles (toner cartridges) 25*a*, 25*b*, 25*c* and 25*d*. As images are output, toner in the developing devices is constantly replaced. If images that require small toner consumption are output in a row, little toner is replaced. As a result, the same toner remains in developing device 4 for a prolonged period of time.

Toner that stays for a prolonged period of time deteriorates as it is rubbed by photoreceptor 3 and the development blade and the like. Deteriorated toner possesses reduced electric chargeability and fluidity. The use of deteriorated toner for development results in decrease in image density and other various image qualities.

To prevent this, the image forming apparatus of the present embodiment uses toner for development (i.e. it discharges it) whenever printing successive images that require small toner consumption (images with low CW ratios) causes the amount of toner staying in the developing devices to increase to a certain degree. It then supplies them with new toner from the toner bottles. Thus, it maintains the amount of staying toner in the developing devices below a certain level.

"CW ratio" means the color/white ratio, which is the percentage of an image area relative to a sheet area.

The amount of staying toner can be determined by the following:

amount of staying toner=(cumulative amount of rotation of developer roller/standard amount of rotation)×3%−total(cumulative)CW ratio % (Equation 1)

"Standard amount of rotation" means the amount of rotation of the developer roller when one A4 sheet is printed. In connection with the image forming apparatus of the present embodiment, calculations will be made on the assumption that there is no such toner stay (deterioration) as to cause a decrease in image quality if the CW ratio per A4 sheet is not less than 3%. Thus, the difference between a given amount and 3% is the amount of staying toner.

That is, the difference between the standard amount of toner that should be consumed for a certain amount of drive for development (i.e. (cumulative amount of rotation of developer roller/standard amount of rotation)×3%) and the amount of toner that was actually consumed (i.e. total CW ratio) will be determined, and that difference will be registered as the amount of staying toner.

The CW ratio is the percentage of an image area relative to a sheet area. For example, in the case of A4 (297×210 mm) and 600 dots per inch (dpi: 1 inch=25.4 mm), the sheet area comprises:

(297×210)/(25.4/600)dots and, for an image with a CW ratio of 3%, the image area comprises:

{(297×210)/(25.4/600)}×0.03 dots.

The image forming apparatus does not simply calculate a CW ratio using the sum of all the pixels (dots) forming an image, but makes adjustments based on the density of a pixel and the distribution of pixels surrounding that pixel to calculate a CW ratio.

Further, the CW ratio of the present embodiment is not the CW ratio based on the size of an image to be printed, but the CW ratio based on the size of a sheet (A4 size) (i.e. The CW ratio can be calculated dividing number of dots forming image by number of dots for A4 size sheet).

Also, "total CW ratio" in Equation 1 is the accumulated value of the CW ratios for images printed.

Since the amount of staying toner is never negative, the amount of staying toner is "zero" if a value resulting from Equation 1 is not more than zero.

The controller unit computes the CW ratio of an image before instructing the engine unit to print it. The engine unit, when instructed by the controller unit to print, initiates a printing operation and measures the amount of rotation of the developer roller. Thus, the "cumulative amount of rotation of developer roller" of Equation 1 can be calculated.

Further, the engine unit sums up the CW ratios received from the controller unit to determine the "total CW ratio" of Equation 1. The engine unit determines the amount of staying toner using Equation 1 each time it finishes printing one sheet. If the amount of staying toner exceeds a first threshold, the engine unit interrupts printing and discharges the staying toner.

It also discharges the staying toner if the amount of staying toner exceeds a second threshold when a print job is finished.

The first threshold is the limit below which the image quality does not decrease. The second threshold is around a fifth of the first threshold. The second threshold is provided so that, if a certain amount of staying toner is present at the end of a job, the toner can be discharged in order to prevent interruption of printing based on the first threshold.

When the staying toner is discharged, the "cumulative amount of rotation of developer roller" and the "total CW ratio" are cleared.

The amount of staying toner increases or decreases subject to the CW ratio of images printed. Since the amount of staying toner is never below zero, the present embodiment minimizes the amount of staying toner by reordering print jobs.

Figure 4:
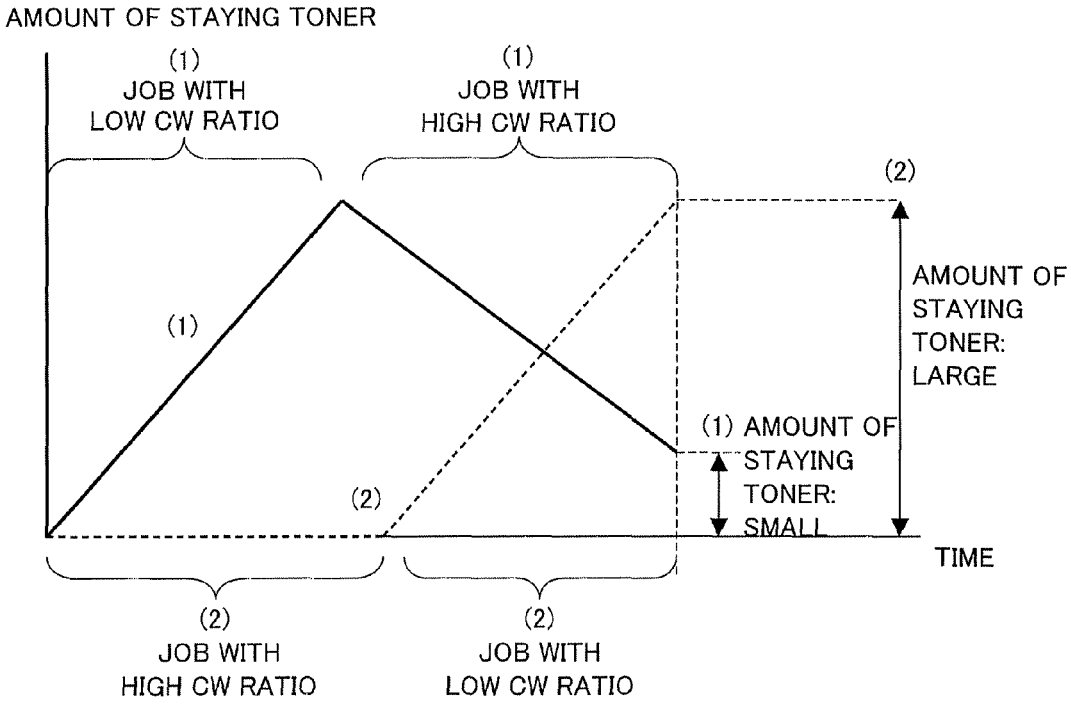
FIG. 4 shows how the amount of staying toner varies when several jobs are printed, where the amount of staying toner starts at "zero".

FIG. 4 shows how the amount of staying toner varies when several jobs are printed, where the amount of staying toner starts at "zero".

It illustrates how the amount of staying toner changes when two jobs (a job with a low CW ratio and a job with a high CW ratio) are performed in a row. The horizontal axis indicates the time, while the vertical axis indicates the amount of staying toner. "Job with a low CW ratio" means a job with a CW ratio less than 3%, while "job with a high CW ratio" means a job with a CW ratio not less than 3%. Performing a job with a low CW ratio will lead to an increased amount of staying toner due to small consumption of toner, while performing a job with a high CW ratio will result in a decrease in the amount of staying toner due to large consumption of toner.

The solid line, indicated by (1), shows how the amount of staying toner changes when a job with a low CW ratio is followed by a job with a high CW ratio, while the dashed line, (2), shows how the amount of staying toner changes when a job with a high CW ratio is followed by a job with a low CW ratio.

The cumulative CW ratio itself remains the same whether (1) or (2) is performed.

If (2) is performed, a job with a high CW ratio is printed with the amount of staying toner being zero, so that the amount of staying toner does not increase, but remains at zero in the first half. The amount of staying toner increases in the latter half when a job with a low CW ratio is printed.

If (1) is performed, a job with a low CW ratio is printed first, leading to an increase in the amount of staying toner. The amount of staying toner decreases in the latter half when a job with a high CW ratio is printed.

Consequently, performing (1) will result in a smaller amount of staying toner at the end of the printing than performing (2). Thus, the present embodiment controls the image forming apparatus in such a way that the order of printing is altered to reduce the amount of staying toner at the end of the printing even though the total CW ratio for several jobs remains the same.

More specifically, the control unit determines the total CW ratio for all the jobs prior to printing, and reorders the jobs according to the amount of staying toner.

Suppose that, with a small amount of staying toner, a job with a high CW ratio is about to be performed. If printing this job would lead to an amount of staying toner not more than zero, another job with a low CW ratio is preferenced.

On the other hand, suppose that with a large amount of staying toner, a job with a low CW ratio is about to be performed. If printing this job would lead to an amount of staying toner exceeding the second threshold and thus the staying toner being discharged, another job with a high CW ratio is preferenced.

Referring to the example of FIG. 4, the amount of staying toner is zero at first. Performing a job with a high CW ratio would lead to an amount of staying toner below zero for calculation purposes (since the actual amount of staying toner is never less than zero, zero is recorded if it is calculated to be less than zero). Thus, the job with a high CW ratio enters the stand-by state and another job with a lower CW ratio is performed. Thereafter, the job with a high CW ratio which was at stand-by state is performed. That is, the image forming apparatus of the present embodiment performs the process indicated by the solid line (1), not the one indicated by the dashed line (2). That will reduce the amount of staying toner at the end of the printing.

Figure 5:
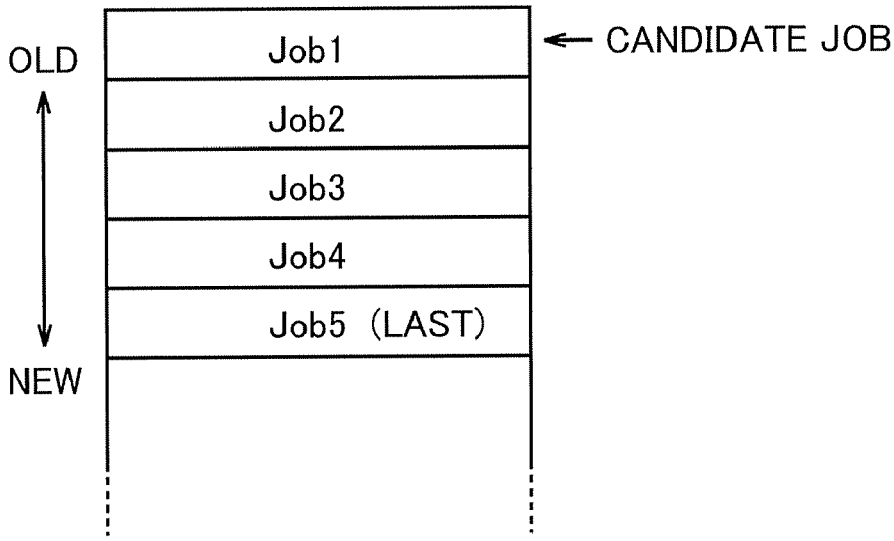
FIG. 5 is a job management table managed by the image forming apparatus.

FIG. 5 is a job management table managed by the image forming apparatus.

The jobs are numbered starting at the oldest registered job. In this example, job 1 is the oldest and job 5 is the newest (i.e. one that was registered last). Basically, the older a job is, the earlier it is performed. That is, job 1 is a candidate job to be performed.

Before performing job 1, which is the candidate job, the estimated amount of staying toner after job 1 is performed is calculated based on the current amount of staying toner and the CW ratio for job 1. If the estimated amount of staying toner is not more than zero or exceeds the second threshold, job 1 is suspended and the next job, job 2, becomes the new candidate job. Then, a process similar to that for job 1 is performed for job 2.

If the estimated amount of staying toner after job 1 is performed is more than zero and not more than the second threshold, job 1 is performed.

Figure 6:
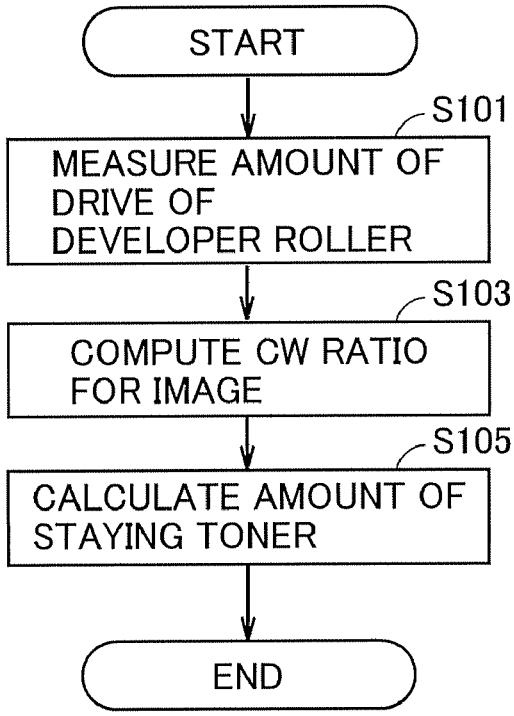
FIG. 6 is a flow chart showing a process for calculating the amount of staying toner when one image is printed, performed by the image forming apparatus.

FIG. 6 is a flow chart showing a process for calculating the amount of staying toner when one image is printed, performed by the image forming apparatus.

Referring to the figure, at step S101, the amount of drive (i.e. the amount of rotation) of the developer roller is calculated. Toner deteriorates as the amount of drive of the developer roller increases. Step S101 measures this degree of deterioration.

At step S103, the CW ratio of the image that has been printed is computed. When an image with a large CW ratio is printed, the corresponding amount of toner is discharged and new toner of that amount is introduced into the developing device, leading to smaller degrees of deterioration of toner in the developing device. Step S103 measures this amount of discharged toner.

At step S105, the amount of staying toner is calculated according to Equation 1, based on the amount of drive of the developer roller and the CW ratio of the image. Note that the process of S101 to S105 is repeated if several print jobs are involved.

Figure 7:
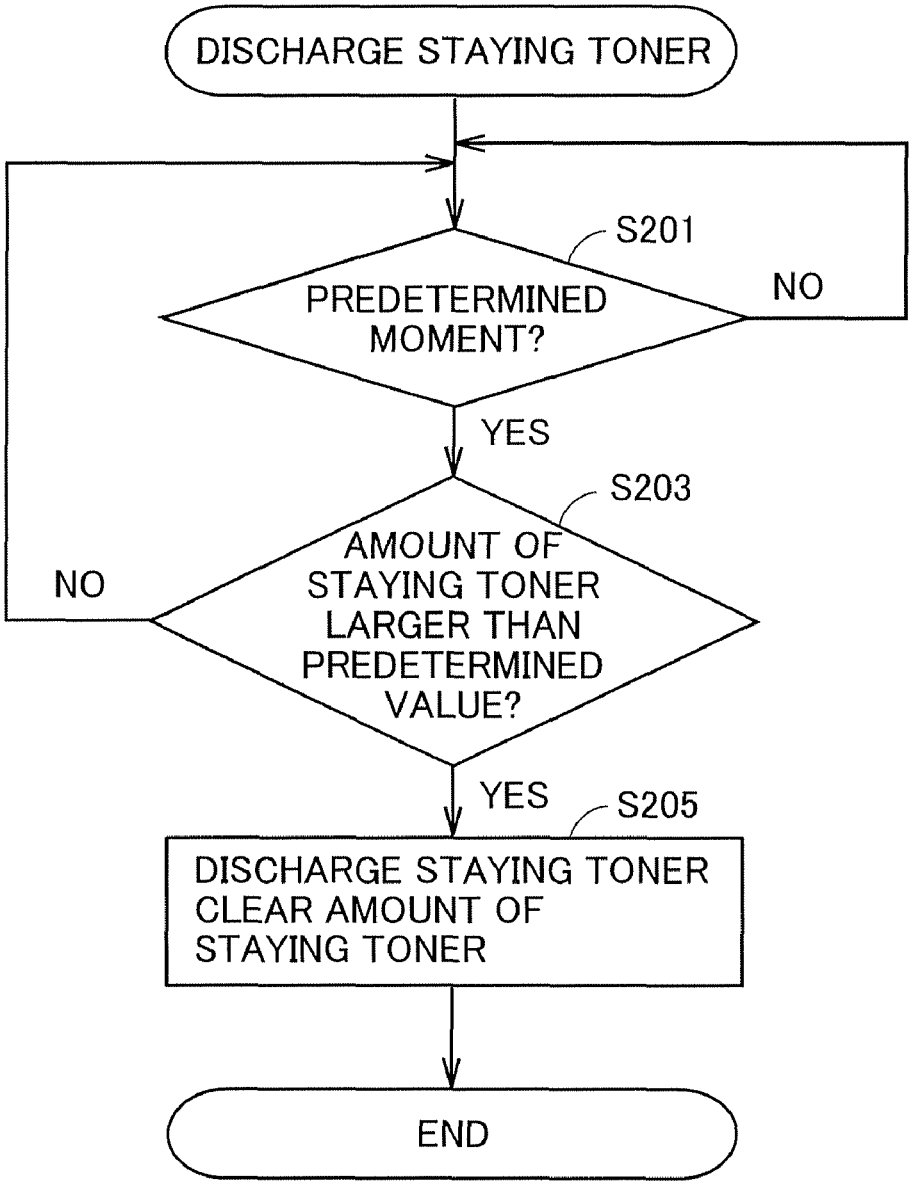
FIG. 7 is a flow chart showing a process for discharging staying toner.

FIG. 7 is a flow chart showing a process for discharging staying toner.

Referring to the figure, at step S201, it is determined whether it is a predetermined moment right now. A predetermined moment is when one image has just been printed or one job has just been completed.

If YES at step S201, it is determined whether the amount of staying toner calculated by the process of FIG. 6 is larger than a predetermined value at step S203. The "predetermined value" is the first threshold if printing of an image has just been completed. It is the second threshold if a print job has just been completed.

If YES at step S203, the staying toner is discharged at step S205 and the amount of staying toner is cleared. Then, the process is completed.

If NO at step S203, the process returns to step S201.

Figure 8:
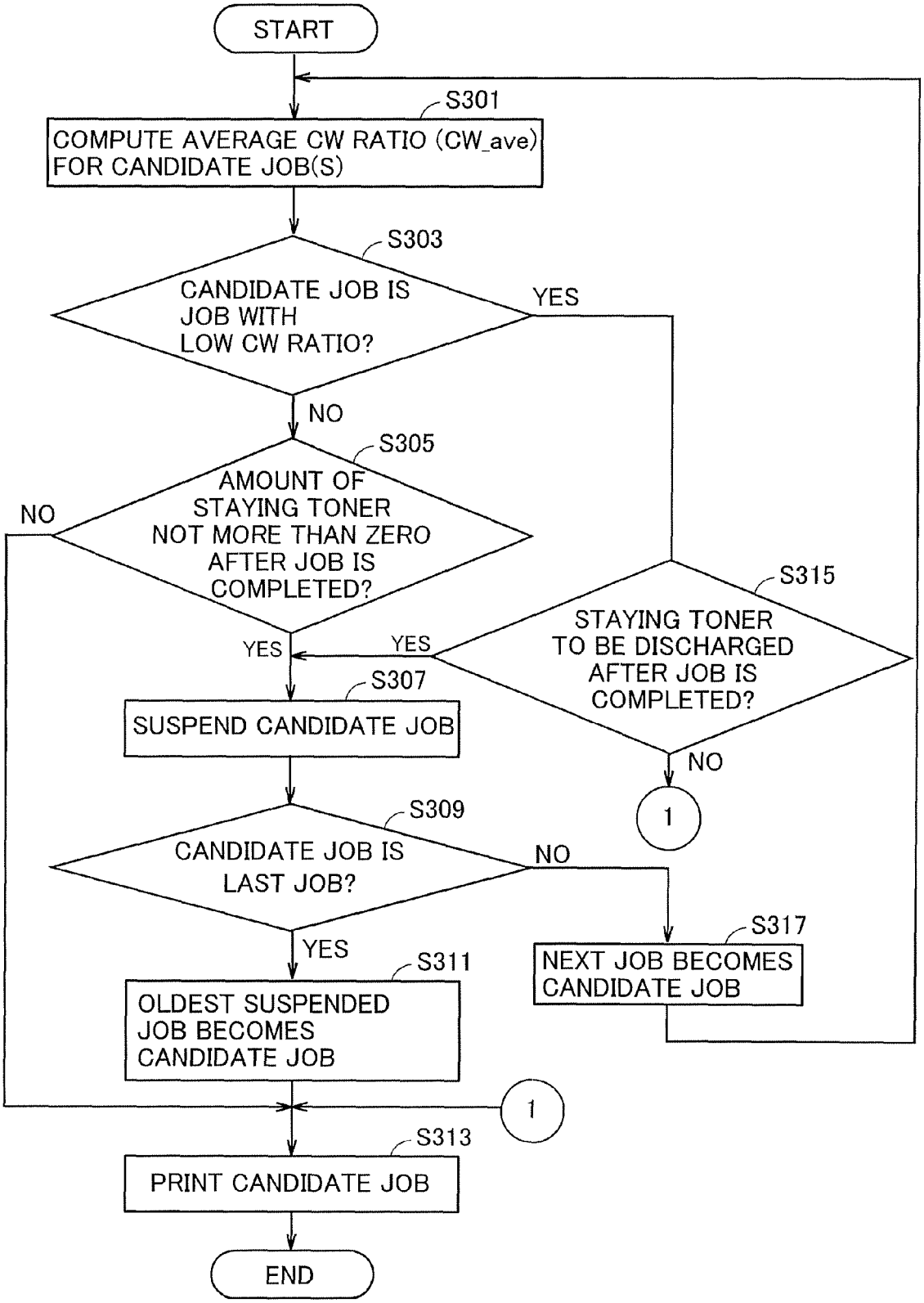
FIG. 8 is a flow chart showing a process for reordering jobs.

FIG. 8 is a flow chart showing a process for reordering jobs.

Suppose that the first (oldest) print job is registered as the print candidate job, as described referring to FIG. 5.

At step S301, the average CW ratio for the candidate job (CW_ave) is determined. If the job involves one image to be printed, the average CW ratio for the job is the CW ratio for that image. If the job involves several images to be printed, it is the average CW ratio for these images.

At step S303, it is determined whether the candidate job is a job with a low CW ratio. Specifically, it is determined if CW_ave for the candidate job is smaller than 3%. If YES (i.e. CW_ave is smaller than 3%), the amount of staying toner will have increased in general when this candidate job is completed. Thus, at step S315, it is determined if the staying toner should be discharged after the candidate job is completed. Specifically, it is determined if $$(3\%-\text{CW_ave})\times\text{number of pages for job}+\text{current amount of staying toner}>\text{second threshold}$$

is satisfied.

That is, the amount of staying toner after the candidate job is completed is estimated based on the current amount of staying toner and CW_ave. If the amount of staying toner after the candidate job is completed is expected to exceed the second threshold, which means that the staying toner should be discharged (YES at S315), then printing of this candidate job is suspended at step S307.

On the other hand, if the amount of staying toner after the candidate job is completed is expected to be not more than the second threshold, which means that the staying toner should not be discharged (NO at S315), then printing of this candidate job is performed at step S313.

If NO at step S303 (i.e. CW_ave is not less than 3%), the amount of staying toner will have decreased in general when this candidate job is completed. Thus, at step S305, it is determined whether the amount of staying toner after the candidate job is completed will be not more than zero. Specifically, it is determined if $$(\text{CW_ave}-3\%)\times\text{number of pages for job}>\text{current amount of staying toner}$$

is satisfied.

That is, the amount of staying toner after the candidate job is completed is estimated based on the current amount of staying toner and CW_ave. If the amount of staying toner after the candidate job is completed is expected to be not more than zero (YES at S305), printing of this candidate job is suspended at step S307.

On the other hand, if the amount of staying toner after the candidate job is completed is expected to be more than zero (NO at S305), printing of the candidate job is performed at step S313.

If the candidate job is suspended at step S307, it is determined whether the current candidate job is the last job at step S309. The last job is the newest job, as shown in FIG. 5. If it is not the last job (NO at S309), the next job in order is registered as the print candidate job at step S317 and the process starting at step S301 is performed.

If the job suspended at step S307 is the last job (YES at S309), the oldest one of the suspended jobs becomes the candidate job at step S311 and that job is printed at step S313.

If the last job was suspended, it means that all the jobs were suspended. In this case, reordering the jobs will not cause a change in the amount of staying toner at the end of the printing. Thus, reordering should not be performed.

If, after a job is suspended, the subsequent job is printed without being suspended, the amount of staying toner changes. Therefore, it is now possible that a suspended job can be printed. In order to minimize job reordering, it is desirable to reexamine if a suspended job can now be printed if another job was printed during suspension of the job. Specifically, it is desirable to perform the process starting at step S301 with the oldest job being the candidate job after printing was performed at step S313 of FIG. 8.

According to the present embodiment, as described above, the image forming apparatus reorders images to be printed based on the amount of staying toner. More specifically, when several print jobs remain unperformed, printing an image with a high CW ratio is preferenced in the case of a large amount of staying toner (NO at S305 in FIG. 8), while printing an image with a low CW ratio is preferenced in the case of a small amount of staying toner (NO at S315 in FIG. 8).

In the case of a large amount of staying toner, processing an image with a high CW ratio is preferenced, leading to a temporary decrease in the amount of staying toner so that the discharge of the staying toner occurs less frequently (i.e. is postponed). Although it is possible that printing a subsequent image with a low CW ratio may result in the conditions for the discharge of the staying toner being met, the discharge of the staying toner due to a temporary increase of staying toner is prevented.

In the case of a small amount of staying toner, processing an image with a low CW ratio is preferenced, leading to a temporary increase in the amount of staying toner. But it is possible that printing a subsequent image with a high CW ratio may result in a decreased amount of staying toner. Since the amount of staying toner is never less than zero, this is more likely to achieve a decrease in the amount of staying toner at the end of the printing than printing an image with a high CW ratio first or not reordering.

[First Modification]

In FIG. 8, older jobs become candidate jobs first, followed by newer jobs, and it is determined if a candidate job satisfies a condition. For example, in the decision at step S305, older jobs that satisfy a condition (jobs that yield NO at S305) are performed first. Alternatively, all the registered jobs may be examined to see if they meet a condition and, of the jobs that meet the condition, ones that result in as small an amount of staying toner as possible may be performed in preference. That is, of the jobs that do not result in an amount of staying toner not more than zero after their completion, jobs with as large a CW ratio as possible may be preferenced. This achieves a reduced amount of staying toner in the developing devices, improving image qualities.

[Second Modification]

The amount of staying toner may be recorded for each of the developing devices for the different colors, and a developing device with an increased amount of staying toner may discharge the staying toner.

[Third Modification]

While in the above embodiment the amount of rotation of the development motor (i.e. the amount of drive of the developer roller) is acquired and the amount of staying toner is determined based on the CW ratio for that amount of rotation, other information may be acquired as the conditions of toner in the developing devices. For example, the amount of rotation of the photoreceptor and other values that are proportional to the amount of rotation of the developer roller may be acquired, or the amount of staying toner may be determined by acquiring the CW ratio for the number of sheets to be printed.

Second Embodiment

The basic configuration of the image forming apparatus of the second embodiment of the present invention is the same as that of the image forming apparatus of the first embodiment, and the description thereof will not be repeated. The following describes the points in which the image forming apparatus of the second embodiment differs from the image forming apparatus of the first embodiment.

In the image forming apparatus of the second embodiment, a decision about whether or not to discharge the staying toner for each sheet printed using the first threshold is made according to the flowchart of FIG. 7. A decision about whether or not to discharge the staying toner during a pause between jobs using the second threshold is made according to the flowchart of FIG. 9.

Figure 9:
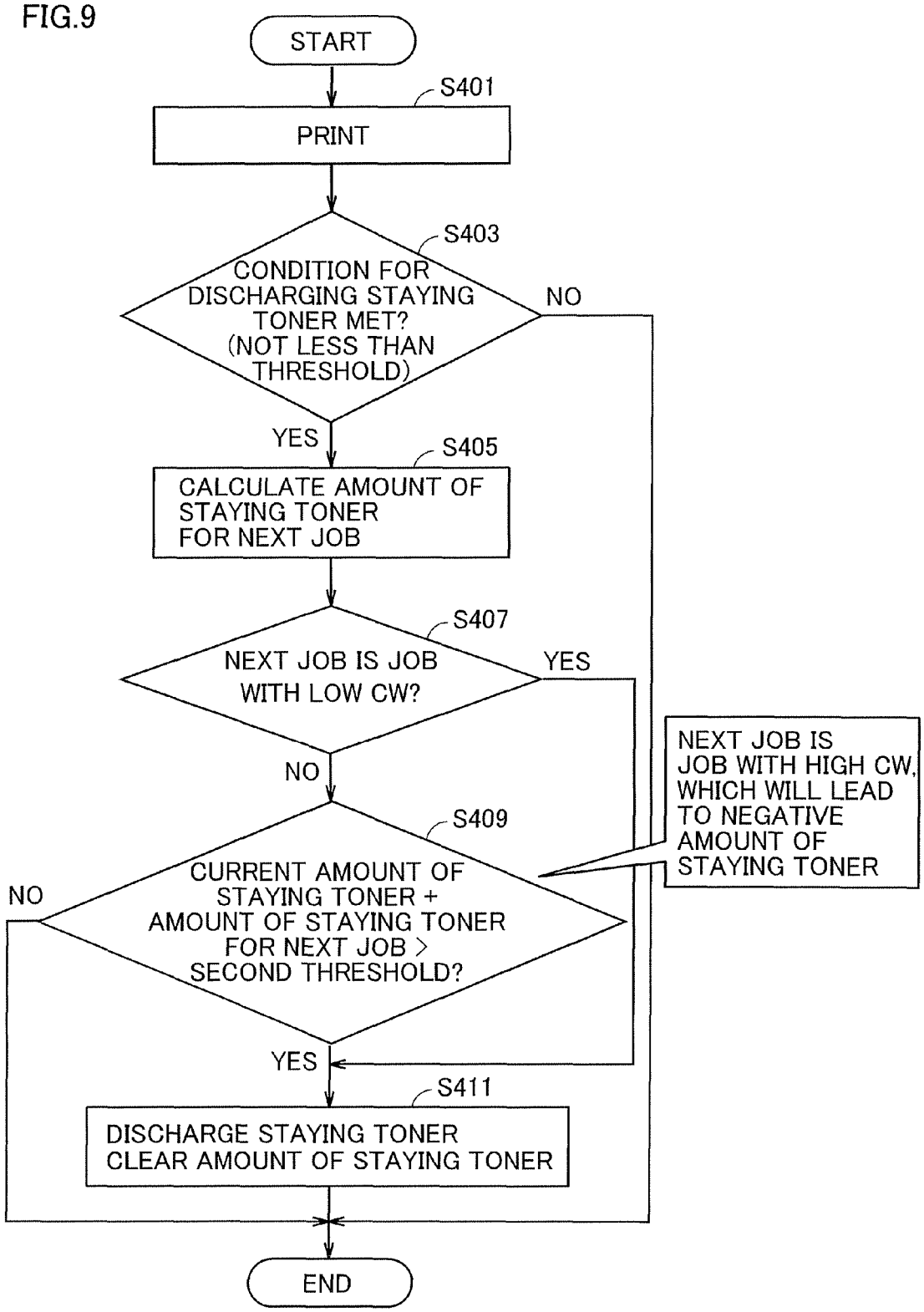
FIG. 9 is a flow chart showing a process for deciding whether or not to discharge the staying toner during a pause between jobs, performed by the image forming apparatus of the second embodiment.

FIG. 9 is a flow chart showing a process for deciding whether or not to discharge the staying toner during a pause between jobs, performed by the image forming apparatus of the second embodiment.

After one job is performed at step S401 (i.e. during a pause between jobs), it is determined if the conditions for discharging the staying toner are met at step S403. That is, it is determined if the staying toner exceeds the second threshold at this moment.

If YES at step S403, the CW ratio for the job to be performed next and the amount of staying toner resulting from that job are calculated at step S405. At step S407, it is determined if the job to be performed next is a job with a low CW ratio. If NO (i.e. if it is a job with a high CW ratio), performing that job will reduce the amount of staying toner. Thus, at step S409, it is determined whether the sum of the current amount of staying toner and the amount of staying toner resulting from the next job exceeds the second threshold. Since the next job is a job with a high CW ratio in this scenario, the amount of staying toner after the next job is performed will be negative.

If YES at step S409, which means that the amount of staying toner will exceed the second threshold even after the next job is performed, then the staying toner is discharged at this moment at step S411. The amount of staying toner is cleared.

If NO at step S409, which means that the amount of staying toner will not be more than the second threshold after the next job is performed, then the staying toner is not discharged at this moment and the process is completed.

If NO at step S403, the staying toner does not exceed the second threshold at this moment, and thus the staying toner is not discharged and the process is completed.

Further, if YES at step S407, the job to be performed next is a job with a low CW ratio which, even when performed, would not significantly decrease the amount of staying toner, and thus the process proceeds to step S411 where the staying toner is discharged at this moment. The amount of staying toner is cleared.

Thus, the image forming apparatus of the second embodiment prevents the discharge of the staying toner if, in the case that the amount of the staying toner exceeds the second threshold after a job was completed, the job to be performed next is a job with a high CW ratio and performing that job will result in an amount of staying toner that does not exceed the second threshold.

Third Embodiment

The basic configuration of the image forming apparatus of the third embodiment of the present invention is the same as that of the image forming apparatus of the first embodiment, and the description thereof will not be repeated. The following describes the points in which the image forming apparatus of the third embodiment differs from the image forming apparatus of the first embodiment.

The image forming apparatus of the present embodiment computes the total CW ratio for all the remaining jobs during a pause between jobs. If the amount of staying toner after all the jobs are completed is expected to be not more than the second threshold, the discharge of the staying toner based on the second threshold during that pause is not performed, because performing all the jobs will result in an amount of staying toner not more than the second threshold and thus the discharge of the staying toner during that pause is hardly necessary.

Figure 10:
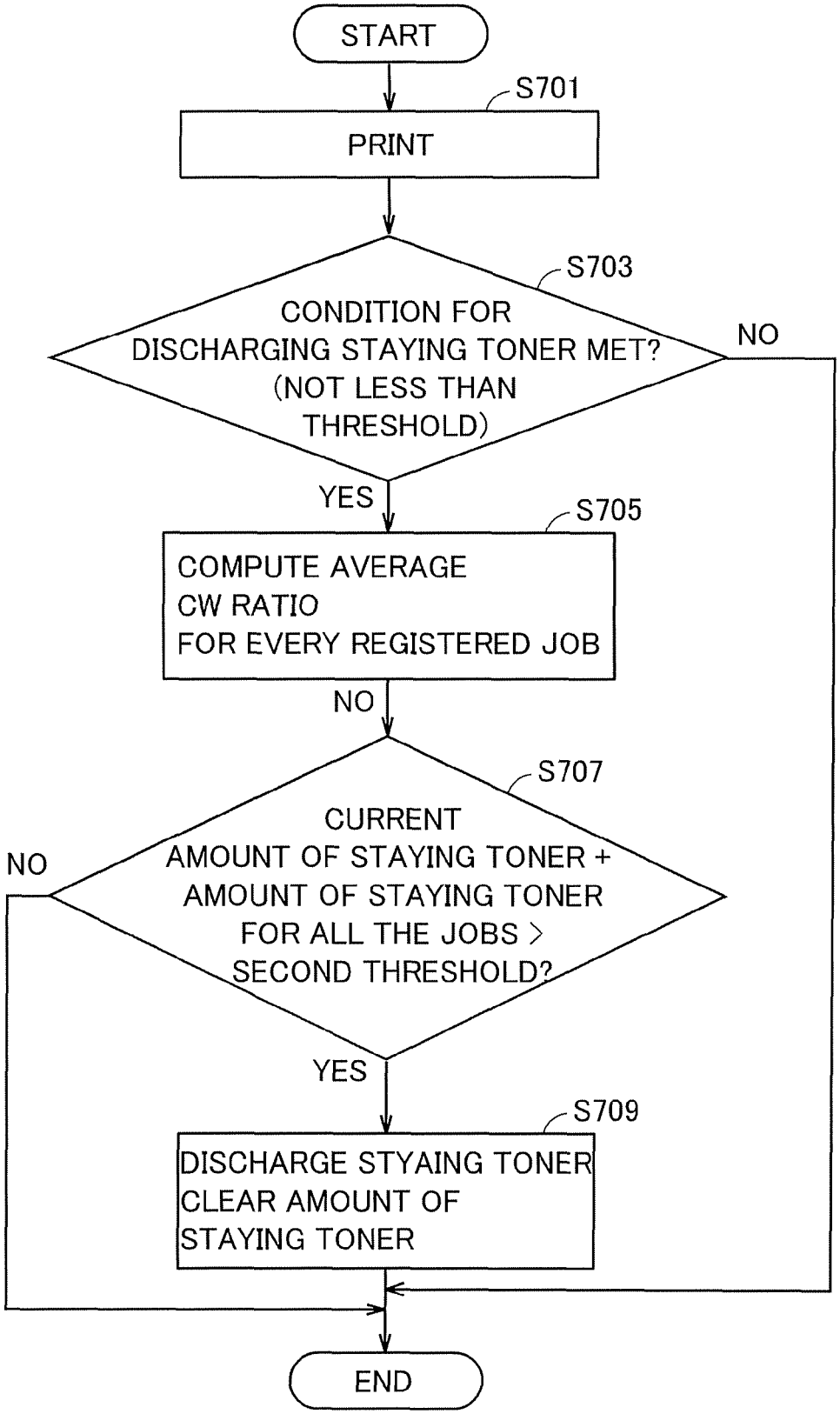
FIG. 10 is a flow chart showing a process for deciding whether or not to discharge the staying toner during a pause between jobs, performed by the image forming apparatus of the third embodiment.

FIG. 10 is a flow chart showing a process for deciding whether or not to discharge the staying toner during a pause between jobs, performed by the image forming apparatus of the third embodiment.

After one job is performed at step S701 (i.e. during a pause between jobs), it is determined if the conditions for discharging the staying toner are met at step S703. That is, it is determined if the staying toner at that moment exceeds the second threshold.

If YES at step S703, the average CW ratio for each of the jobs registered at that moment as well as the amount of staying toner that will exist at the end of the printing after all the jobs are performed are calculated at step S705. At step S707, it is determined if the sum of the current amount of staying toner and the amount of staying toner resulting from all the jobs will exceed the second threshold.

If YES at step S707, which means that the amount of staying toner will exceed the second threshold even after all the job are performed, then the staying toner is discharged at this moment at step S709. The amount of staying toner is cleared.

If NO at step S707, which means that performing all the jobs will lead to an amount of staying toner at the end of the printing not more than the second threshold, then the staying toner is not discharged at this moment and the process is completed.

If NO at step S703, the staying toner does not exceed the second threshold at this moment and thus the staying toner is not discharged and the process is completed.

According to the third embodiment, as described above, the image forming apparatus minimizes the amount of staying toner at the end of the printing if, in the case that the amount of staying toner exceeds the second threshold after a job was completed, performing all the jobs registered at that moment will result in an amount of staying toner not more than the second threshold. Further, toner consumption due to the discharge of the staying toner can be minimized.

Fourth Embodiment

The basic configuration of the image forming apparatus of the fourth embodiment of the present invention is the same as that of the image forming apparatus of the first embodiment, and the description thereof will not be repeated. The following describes the points in which the image forming apparatus of the fourth embodiment differs from the image forming apparatus of the first embodiment.

Suppose that, at step S201 of the flow chart of FIG. 7, the image forming apparatus of the present embodiment is at a predetermined moment (i.e. YES at S201) after an image stabilization process executed by engine unit 200 was completed or a print job was completed. At step S203, a plurality of predetermined values (thresholds for the amount of staying toner) are used for determining if the staying toner should be discharged.

That is, the condition for discharging the staying toner after a print job was completed is different from the condition for discharging the staying toner after an image stabilization process was completed. The threshold used after an image stabilization process was completed (i.e. a third threshold) is larger than the threshold used when a print job was completed (i.e. the second threshold).

Thus, the staying toner is less likely to be discharged after an image stabilization process was completed, and thus the discharge of the staying toner occurs less frequently (i.e. is postponed). Although the condition for discharging the staying toner may be met after subsequent printing, the discharge of staying toner following a temporary increase of staying toner due to the image stabilization is prevented.

The threshold used when an image stabilization process was completed (i.e. the third threshold) may be larger than the threshold used after the printing of one image was completed while a print job is performed (i.e. the first threshold). Alternatively, the third threshold may be equal to the first threshold.

The controller unit of the image forming apparatus of the present embodiment computes the CW ratio of an image to be printed before instructing the engine unit to print it. Instructed by the controller unit to print, the engine unit initiates a printing operation and computes the amount of rotation of the developer roller. Thus, the cumulative amount of rotation of the developer roller in Equation 1 can be calculated.

The engine unit also sums up the CW ratios received from the controller unit to determine the total CW ratio. The engine unit determines the amount of staying toner using Equation 1 each time it finishes printing one sheet. If the amount of staying toner exceeds the second threshold after a print job is completed, the engine unit discharges the staying toner. The second threshold is 40% in this particular implementation, although the present invention is not limited thereto. It should be noted that "40%" is 40% where the amount of staying toner used to print one A4 sheet all over is represented by "100%".

During an image stabilization process, a pattern is printed on the intermediate transfer belt. Since the CW ratio for the printed pattern is not more than 3%, performing an image stabilization process increases the amount of staying toner. The amount of staying toner is determined not only upon completion of printing, but also upon completion of an image stabilization process, and the staying toner is discharged if the amount of staying toner is larger than the third threshold. The third threshold is 200% in this particular implementation, although the present invention is not limited thereto. It should be noted that "200%" is 200% where the amount of staying toner used to print one A4 sheet all over is represented by "100%".

Since the pattern to be printed on the intermediate transfer belt during image stabilization is fixed in advance, its CW ratio may be stored in the engine as a fixed value. In this case, no CW ratio is transmitted from the controller.

When the staying toner is discharged, the cumulative amount of rotation of the developer roller and the total CW ratio are cleared.

The third threshold is not more than the amount of staying toner starting to cause a decrease in image quality and larger than the second threshold. The third threshold is larger than the amount of staying toner that can be accumulated during one image stabilization process.

Figure 11:
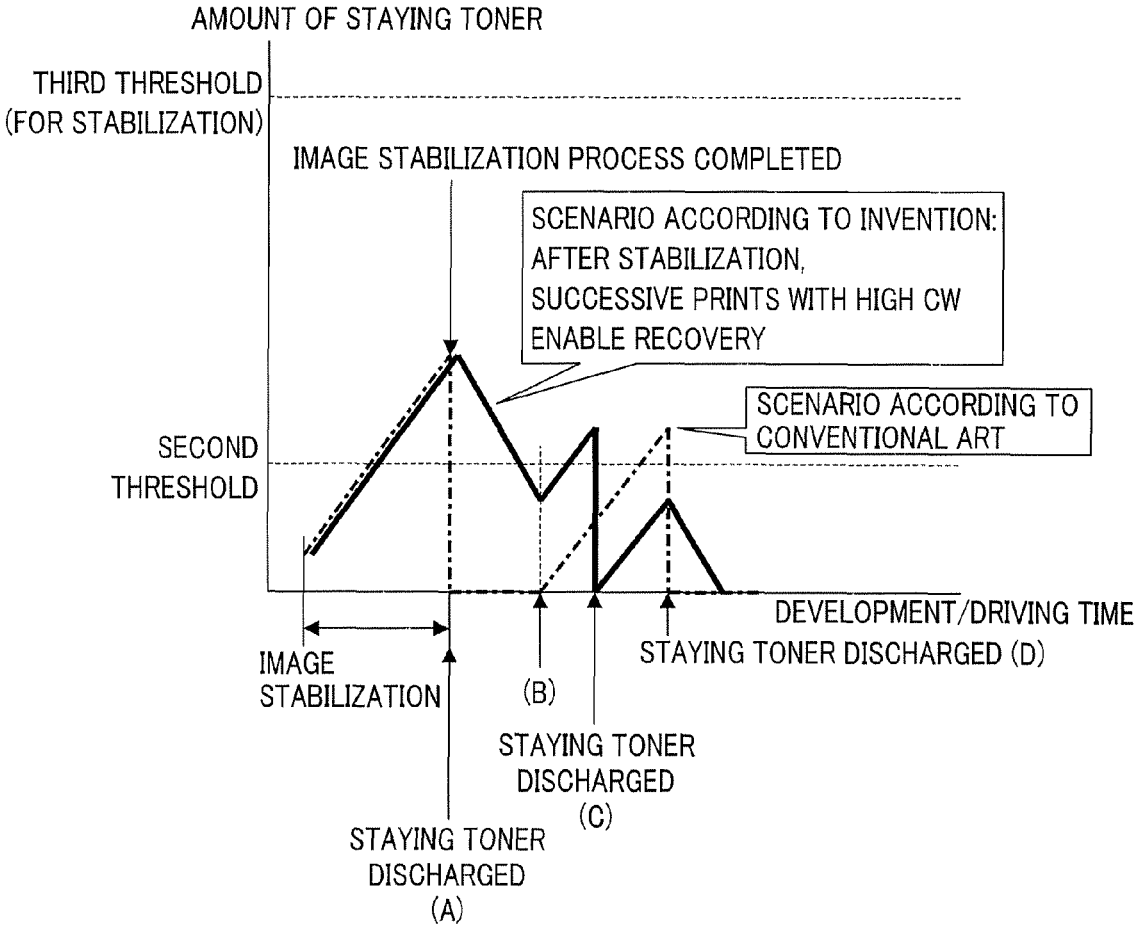
FIG. 11 shows how the amount of staying toner varies when an image stabilization is performed before a print job is performed.

FIG. 11 shows how the amount of staying toner varies when an image stabilization process is performed before a print job is performed.

The figure illustrates how the amount of staying toner changes if an image stabilization process is performed before a print job with a high CW ratio is performed. The horizontal axis indicates the time while the vertical axis indicates the amount of staying toner. The dashed-dotted line indicates the amount of staying toner according to the conventional art, while the solid line indicates the amount of staying toner according to the present embodiment.

The amount of accumulated staying toner after an image stabilization process is larger than the second threshold. According to the conventional art, the staying toner is discharged after an image stabilization process is completed (A).

However, image qualities do not deteriorate immediately after the amount of staying toner exceeds the second threshold. While there is an amount of staying toner larger than the second threshold after an image stabilization process is completed (A), an image with a high CW ratio may be subsequently printed. Therefore, the present embodiment does not discharge the staying toner based on the second threshold after an image stabilization process is completed. This will minimize unnecessary toner consumption.

According to the conventional art, whether or not an image stabilization process is followed by a print job with a high CW ratio which consumes a large amount of toner, the amount of staying toner is zero after that job is completed (B) since the toner was already discharged after the image stabilization process was completed (A). According to the present embodiment, it is not unlikely that the amount of staying toner is smaller than the second threshold after that job is completed (B) even though the toner was not discharged after the image stabilization process was completed (A).

Thereafter, according to the conventional art, if several print jobs with low CW ratios are performed, the staying toner is discharged when the amount of staying toner becomes equal to the second threshold (D) after a job is completed. Thereafter, the amount of staying toner remains zero whether or not print jobs with high CW ratios are performed.

According to the present embodiment, if the completion of the job (B) is followed by several print jobs with low CW ratios, the staying toner is discharged only when the amount of staying toner becomes equal to the second threshold (C) after these jobs are completed. Thereafter, the amount of staying toner increases if a print job with a low CW ratio is performed, or decreases if a print job with a high CW ratio is performed.

The reasons why the toner should not be discharged based on the second threshold after an image stabilization process will be described in further detail below.

An image stabilization process is performed upon power-on. It is possible that it is only followed by monochrome printing and a turn-off. Monochrome printing consumes no color toner, so that discharging the toner based on the second threshold means consuming color toner even though no color printing has been performed. Thus, if possible, the staying toner should not be discharged following only an image stabilization process.

There is a large amount of staying toner after an image stabilization process is completed. Thus, if there are a plurality of jobs, print jobs with higher CW ratios should be preferenced according to the flow chart of FIG. 8. Further, the processes of the flow charts of FIGS. 9 and 10 can be performed to suspend the discharge of the toner if the staying toner is expected to decrease in the future.

For example, repeated power-on, monochrome printing and power-off as in the above example will result in an increased amount of staying color toner, eventually leading to an amount exceeding the third threshold. In this case, the staying toner should be discharged because that would cause decrease in image qualities in subsequent printing.

Figure 12:
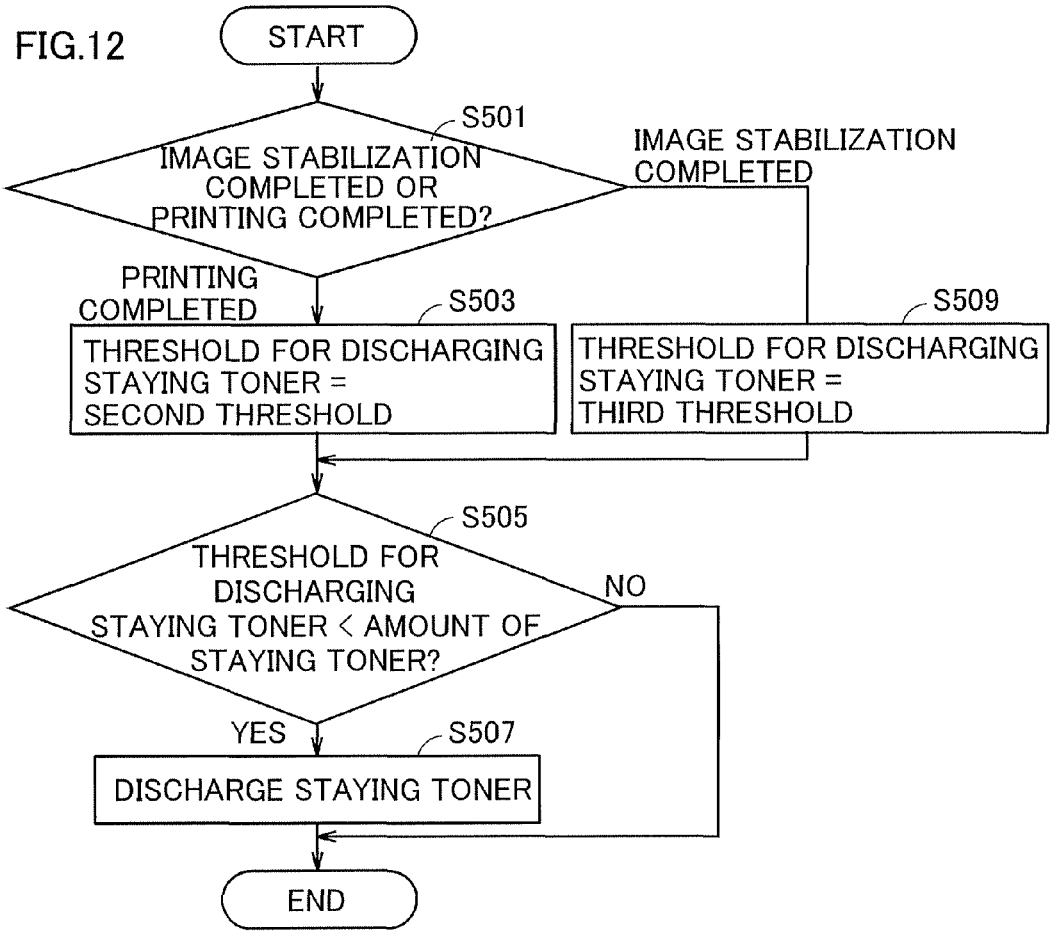
FIG. 12 is a flow chart showing a process for controlling discharge of staying toner according to the fourth embodiment.

FIG. 12 is a flow chart showing a process for controlling discharge of staying toner according to the fourth embodiment.

At step S501, it is determined whether an image stabilization process or a print job was completed. If a print job was completed, the second threshold is set as the threshold for discharging the staying toner at step S503. On the other hand, if an image stabilization process was completed, the third threshold is set as the threshold for discharging the staying toner at step S509.

If, at step S505, it is determined that the amount of staying toner exceeds the threshold for discharging the staying toner (YES at S505), the staying toner is discharged at step S507.

[Effects of the Fourth Embodiment]

As described above, the fourth embodiment provides different conditions for discharging the staying toner after a print job is completed and for discharging the staying toner after an image stabilization process is completed to minimize toner consumption due to the discharge of the staying toner following image stabilization processes which have small CW ratios.

Fifth Embodiment

The fifth embodiment of the present invention provides a printing system including a plurality of image forming apparatus connected to a network and a print server. Each of the image forming apparatus may be an image forming apparatus according to any of the first to fourth embodiments, or an image forming apparatus according to the conventional art.

Upon receiving a job from a client PC, the print server decides which device should output the image (i.e. which image forming apparatus should print the image). The decision is made in such a way that each of the image forming apparatus has a similar amount of staying toner.

That is, image forming apparatus having larger amounts of staying toner print images with high CW ratios, while image forming apparatus having smaller amounts of staying toner print images with low CW ratios.

Figure 13:
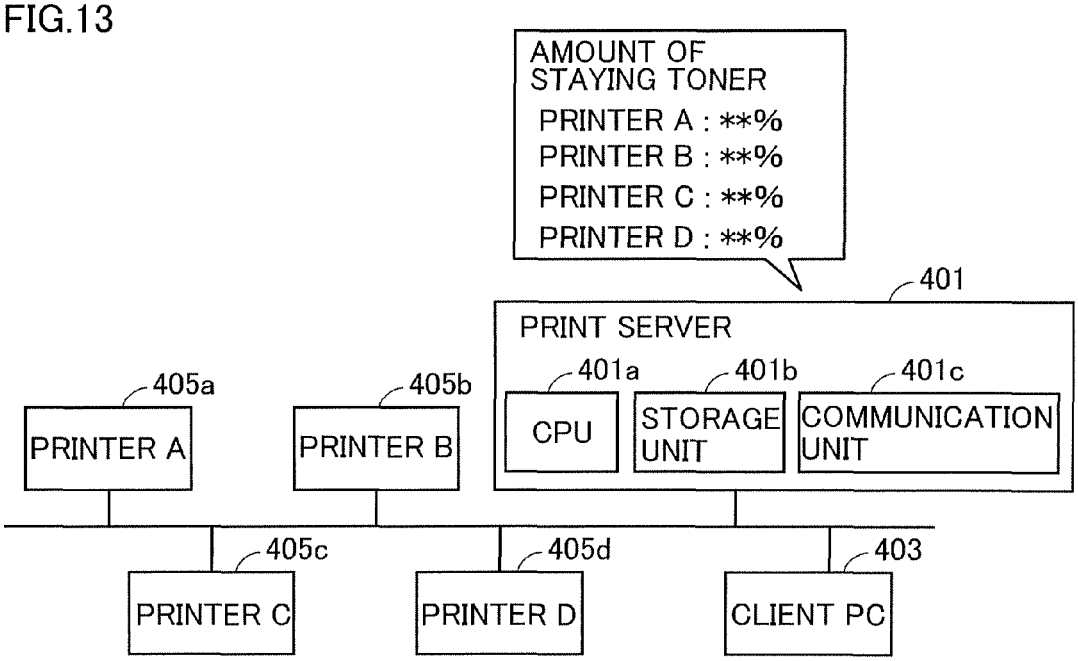
FIG. 13 shows a network to which image forming apparatus are connected.

FIG. 13 shows a network to which image forming apparatus are connected.

Image forming apparatus, i.e. printers 405*a* to 405*d*, are connected to a network. A print server 401 assigns print jobs from a client PC 403 to printers 405*a* to 405*d*.

Print server 401 includes a CPU 401*a*, a storage unit 401*b* and a communication unit 401*c*. Print server 401 manages the amount of staying toner in each of the printers.

Prior to printing, print server 401 estimates the average CW ratio for all the jobs. In the case of an average CW ratio not less than 3%, it instructs the printer with the largest amount of staying toner to print. For an average CW ratio less than 3%, it instructs the printer with the smallest amount of staying toner to print.

The engine unit of the printer which received a print instruction from the controller (print server) initiates a print operation and measures the amount of rotation of the developer roller. Thus, the cumulative amount of rotation of the developer roller in Equation 1 can be calculated.

The engine unit also sums up the CW ratios received from the controller (print server) to determine the total CW ratio. The engine unit determines the amount of staying toner according to Equation 1 each time printing of a sheet is completed. If the amount of staying toner exceeds the first threshold upon completion of printing of one sheet, printing is interrupted and the staying toner is discharged.

The staying toner is also discharged if the amount of staying toner exceeds the second threshold upon completion of a print job.

The first threshold is the limit below which the image quality does not decrease. The second threshold is around a fifth of the first threshold and is provided so that, if there is a certain amount of staying toner at the end of a job, the toner can be discharged in order to prevent interruption of printing based on the first threshold.

If the staying toner is discharged, the cumulative amount of rotation of the developer roller and the total CW ratio are cleared. Upon completion of a job, the printer informs print server 401 of the current amount of staying toner.

Figures 14, 15:
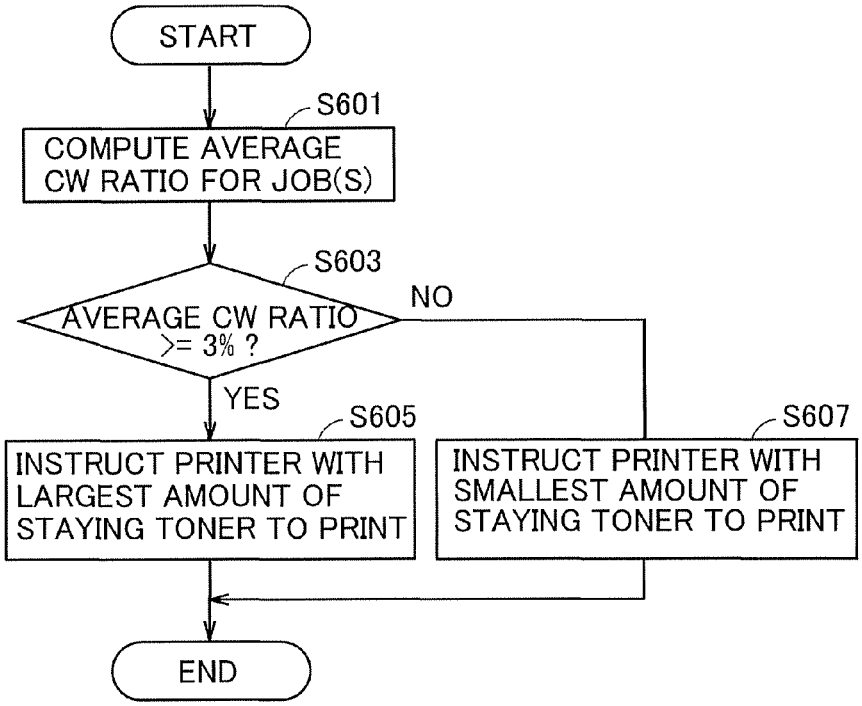
FIG. 14 is a flow chart showing a process for assigning jobs, performed by a print server.
FIG. 15 shows the amounts of staying toner resulting from performing a job and the current amounts of staying toner in each of printers No. 1 to No. 3.

FIG. 14 is a flow chart showing a process for assigning jobs, performed by a print server.

Referring to the figure, upon receiving a print job from the client PC, the print server calculates the average CW ratio for the job at step S601. If it is determined that the average CW ratio is not less than 3% at step S603, it sends the job to the printer with the largest amount of staying toner to be printed at step S605. On the other hand, if it is determined that the average CW ratio is less than 3% at step S603, it send the job to the printer with the smallest amount of staying toner to be printed at step S607.

[Effects of the Fifth Embodiment]

According to the fifth embodiment, as described above, an image forming apparatus with a large amount of staying toner prints images with high CW ratios in preference, decreasing the amount of staying toner therein. An image forming apparatus with a small amount of staying toner prints images with low CW ratios in preference, leading to an increase of the staying toner therein. As a result, the image forming apparatus discharge staying toner less frequently, minimizing unnecessary toner consumption.

Sixth Embodiment

The basic configuration of the printing system of the sixth embodiment of the present invention is the same as that of the printing system of the fifth embodiment, and the description thereof will not be repeated. The following describes the points in which the printing system of the sixth embodiment differs from the printing system of the fifth embodiment.

According to the sixth embodiment, the print server manages the amount of staying toner of each of the colors (Y, M, C and K) in each of the printers. It is determined which printer performs a print job based on the toner consumption for each of the colors for the print job.

More specifically, prior to performing a print job, the print server estimates the amount of staying toner of each of the colors Y, M, C and K that will result from performing the entire job according to the following equation:

$$\text{amount of staying toner} = (3\% - \text{CW_ave}) \times \text{number of pages for job}$$

(If the average CW ratio exceeds 3%, the amount of staying toner will be negative.)

Next, the amount of staying toner resulting from the entire job (for each color) estimated above is added to the current amount of staying toner (for each color) in each of the printers. Thus, the amount of staying toner after the job is printed by each of the printers can be estimated.

At this moment, the estimated amount of staying toner in every printer upon completion of printing of the job is stored. Each printer has four amounts of staying toner for their respective colors, and the greatest of these values is stored.

Suppose that, for example, jobs will be assigned to three printers (referred to as printers No. 1, No. 2 and No. 3).

FIG. 15 shows the amounts of staying toner resulting from performing a job and the current amounts of staying toner in each of printers No. 1 to No. 3.

Suppose that, as shown in (A), performing a job will cause the amounts of staying toner for Y, M, C and K to change by 10, 3, −5 and 2, respectively. Also suppose that printer No. 1 has current amounts of staying toner for Y, M, C and K of 3, 0, 0 and 6, respectively; that printer No. 2 has current amounts of staying toner for Y, M, C and K of 0, 5, 5 and 9, respectively; and that printer No. 3 has current amounts of staying toner for Y, M, C and K of 2, 8, 8 and 4, respectively. Note that "amount of staying toner" indicates the percentage of staying toner where "amount of remaining toner necessary for printing one A4 sheet all over" is 100%.

FIG. 16 shows the resulting amounts of remaining toner in each of printers No. 1 to No. 3 when each of these printers performs the job represented by (A) in FIG. 15.

As shown in (A) in FIG. 16, printing the job represented by (A) in FIG. 15 at printer No. 1 will result in amounts of staying toner for Y, M, C and K in printer No. 1 of 13, 3, 0 and 8, respectively (though the calculated amount for C is −5, the negative value is considered as zero).

Y has the maximum amount of staying toner in No. 1 (the amount will be referred to as A % (=13%)).

As shown in (B) in FIG. 16, printing the job represented by (A) in FIG. 15 at printer No. 2 will result in amounts of staying toner for Y, M, C and K in printer No. 2 of 10, 8, 0 and 11, respectively.

K has the maximum amount of staying toner in No. 2 (the amount will be referred to as B % (=11%)).

As shown in (C) in FIG. 16, printing the job represented by (A) in FIG. 15 at printer No. 3 will result in amounts of staying toner for Y, M, C and K in printer No. 3 of 12, 11, 3 and 6, respectively.

Y has the maximum amount of staying toner in No. 3 (the amount will be referred to as C % (=12%)).

After the maximum amount of staying toner after printing for each printer (A %, B % and C %) is estimated, the maximum amounts of staying toner (A %, B % and C %) are compared with one another. The printer with the smallest maximum amount of staying toner is instructed to print the job.

In this example, printer No. 2 prints the job since printing at printer No. 2 minimizes the maximum for all the colors most effectively.

If there are several printers with the same maximum amount of staying toner, it is desirable to select the printer with the largest minimum amount of staying toner.

[Effects of the Sixth Embodiment]

According to the sixth embodiment, as described above, an image forming apparatus for performing a job is selected based on the amount of staying toner for each color. Thus, staying toner in the image forming apparatus is discharged less frequently, thereby minimizing unnecessary toner consumption.

[Others]

The processes of the above embodiments may be performed by software, or may be implemented by hardware circuitry.

Alternatively, a program for executing the processes of the above embodiments may be provided, or a CD-ROM, a flexible disk, a hard disk, a ROM, a RAM, a memory card or other storage media storing that program may be provided for the user. Further, the program may be transmitted via the Internet or other communication lines and downloaded to a device.

Moreover, some or all the processes of the above embodiments may be combined.

It should be understood that the above embodiments are exemplary only and not restrictive in any way. The scope of the present invention is indicated not by the above description but by the Claims, and all the modifications equivalent to and within the Claims are intended to be included.

What is claimed is:

1. An image forming apparatus comprising:

a developing device for containing toner and performing development operation using toner;

a print performing unit that performs printing using toner;

an image stabilization unit that performs an image stabilization process using toner;

an acquiring unit that acquires an amount of staying toner which is the difference between a standard amount of toner that should be consumed for an amount of development operation and an amount of toner that was actually consumed in the developing device; and a toner discharge unit that, upon completion of printing, discharges toner depending on the amount of staying toner acquired by the acquiring unit and a first reference and, upon completion of an image stabilization process, discharges toner depending on the amount of staying toner acquired by the acquiring unit and a second reference.

2. The image forming apparatus according to claim 1, wherein the acquiring unit acquires the amount of staying toner in the developing device by acquiring an amount of drive of a developer roller as the amount of development operation and a toner consumption for a print job.

3. The image forming apparatus according to claim 1, wherein, upon completion of printing, the toner discharge unit discharges toner depending on whether the amount of staying toner in the developing device acquired by the acquiring unit is larger than a threshold that is the first reference or, upon completion of an image stabilization process, discharges toner depending on whether the amount of staying toner in the developing device acquired by the acquiring unit is larger than a threshold that is the second reference.

4. The image forming apparatus according to claim 1, wherein the acquiring unit determines a difference between a standard amount of toner that should be consumed for an amount of drive of a developer roller as the amount of development operation and an amount of toner that has been actually consumed and acquires that difference as the amount of staying toner.

5. The image forming apparatus according to claim 1, wherein the developing device includes a plurality of developing devices each containing toner of a different color, wherein the amount of staying toner in the developing device is managed for each of the plurality of developing devices.

6. An image forming apparatus comprising:

a developing device for containing toner and performing development operation using toner;

a print performing unit that performs printing using toner;

an image stabilization unit that performs an image stabilization process using toner;

an acquiring unit that acquires an amount of staying toner which is the difference between a standard amount of toner that should be consumed for an amount of development operation and an amount of toner that was actually consumed in the developing device;

a toner discharge unit that, upon completion of printing, discharges toner depending on the amount of staying toner acquired by the acquiring unit and a first reference or, upon completion of an image stabilization process, discharges toner depending on the amount of staying toner acquired by the acquiring unit and a second reference;

a determining unit for determining an amount of toner to be consumed for a print job before the print job is performed, and a suspending unit for suspending the print job depending on the amount of staying toner in the developing device acquired by the acquiring unit and a result of determination by the determining unit.

7. The image forming apparatus according to claim 6, further comprising a controller unit for controlling an order of jobs to be performed such that a print job that the toner consumption is smaller than the toner consumption of a candidate job that is to be performed firstly in a plurality of print jobs is performed in preference to the candidate job, if the plurality of print jobs are registered and the amount of staying toner in the developing device becomes not more than zero by performing the candidate job, based on the amount of staying toner in the developing device acquired by the acquiring unit and the amount of toner to be consumed for the candidate job.

8. The image forming apparatus according to claim 6, further comprising a controller unit for controlling an order of jobs to be performed such that a print job that the toner consumption is larger than the toner consumption of a candidate job that is to be performed firstly in a plurality of print jobs is performed in preference to the candidate job, if the plurality of print jobs are registered and the amount of staying toner in the developing device becomes larger than a threshold that is the first reference by performing the candidate job, based on the amount of staying toner in the developing device acquired by the acquiring unit and the amount of toner to be consumed for the candidate job.

9. An image forming apparatus comprising:

a developing device for containing toner and performing development operation using toner;

a print performing unit that performs printing using toner;

an image stabilization unit that performs an image stabilization process using toner;

an acquiring unit that acquires an amount of staying toner which is the difference between a standard amount of toner that should be consumed for an amount of development operation and an amount of toner that was actually consumed in the developing device;

a toner discharge unit that, upon completion of printing, discharges toner depending on the amount of staying toner acquired by the acquiring unit and a first reference or, upon completion of an image stabilization process, discharges toner depending on the amount of staying toner acquired by the acquiring unit and a second reference;

a subsequent job determining unit for determining an amount of toner to be consumed for a subsequent print job when the toner discharge unit determines that the amount of staying toner in the developing device is larger than a threshold that is the first reference or the second reference, and a discharge suspending unit for suspending toner discharge by the toner discharge unit depending on a result of determination by the subsequent job determining unit.

10. A method of controlling an image forming apparatus including a developing device for containing toner and performing development operation using toner, comprising:

a print performing step of performing printing using toner;

an image stabilization process performing step of performing an image stabilization process using toner;

an acquiring step of acquiring an amount of staying toner which is the difference between a standard amount of toner that should be consumed for an amount of development operation and an amount of toner that was actually consumed in the developing device; and a toner discharging step of discharging toner upon completion of printing, depending on the amount of staying toner acquired in the step of acquiring and a first reference and, upon completion of an image stabilization process, discharging toner depending on the amount of staying toner acquired in the step of acquiring and a second reference.

11. The method of controlling an image forming apparatus according to claim 10, wherein the acquiring step acquires the amount of staying toner in the developing device by acquiring an amount of drive of a developer roller as the amount of development operation and a toner consumption for a print job.

12. The method of controlling an image forming apparatus according to claim 10, wherein, upon completion of printing, the toner discharging step discharges toner depending on whether the amount of staying toner in the developing device acquired by the acquiring step is larger than a threshold that is the first reference or, upon completion of an image stabilization process, discharges toner depending on whether the amount of staying toner in the developing device acquired by the acquiring step is larger than a threshold that is the second reference.

13. The method of controlling an image forming apparatus according to claim 10, wherein the acquiring step determines a difference between the standard amount of toner that should be consumed for an amount of drive of a developer roller as the amount of development operation and an amount of toner that has been actually consumed and acquires that difference as the amount of staying toner.

14. The method of controlling an image forming apparatus according to claim 10, wherein the developing device includes a plurality of developing devices each containing toner of a different color, wherein the amount of staying toner in the developing device is managed for each of the plurality of developing devices.

15. A method of controlling an image forming apparatus including a developing device for containing toner and performing development operation using toner, comprising:

a print performing step of performing printing using toner;

an image stabilization process performing step of performing an image stabilization process using toner;

an acquiring step of acquiring an amount of staying toner which is the difference between a standard amount of toner that should be consumed for an amount of development operation and an amount of toner that was actually consumed in the developing device;

a toner discharging step of discharging toner upon completion of printing, depending on the amount of staying toner acquired in the step of acquiring and a first reference or, upon completion of an image stabilization process, discharging toner depending on the amount of staying toner acquired in the step of acquiring and a second reference;

a determining step for determining an amount of toner to be consumed for a print job before the print job is performed, and a suspending step for suspending the print job depending on the amount of staying toner in the developing device acquired by the acquiring step and a result of determination by the determining step.

16. The method of controlling an image forming apparatus according to claim 15, further comprising a controlling step for controlling an order of jobs to be performed such that a print job that the toner consumption is smaller than the toner consumption of a candidate job that is to be performed firstly in a plurality of print jobs is performed in preference to the candidate job, if the plurality of print jobs are registered and the amount of staying toner in the developing device becomes not more than zero by performing the candidate job, based on the amount of staying toner in the developing device acquired by the acquiring step and the amount of toner to be consumed for the candidate job.

17. The method of controlling an image forming apparatus according to claim 15, further comprising a controlling step for controlling an order of jobs to be performed such that a print job that the toner consumption is larger than the toner consumption of a candidate job that is to be performed firstly in a plurality of print jobs is performed in preference to the candidate job, if the plurality of print jobs are registered and the amount of staying toner in the developing device becomes larger than a threshold that is the first reference by performing the candidate job, based on the amount of staying toner in the developing device acquired by the acquiring step and the amount of toner to be consumed for the candidate job.

18. A method of controlling an image forming apparatus including a developing device for containing toner and performing development operation using toner, comprising:

a print performing step of performing printing using toner;

an image stabilization process performing step of performing an image stabilization process using toner;

an acquiring step of acquiring an amount of staying toner which is the difference between a standard amount of toner that should be consumed for an amount of development operation and an amount of toner that was actually consumed in the developing device;

a toner discharging step of discharging toner upon completion of printing, depending on the amount of staying toner acquired in the step of acquiring and a first reference or, upon completion of an image stabilization process, discharging toner depending on the amount of staying toner acquired in the step of acquiring and a second reference;

a subsequent job determining step for determining an amount of toner to be consumed for a subsequent print job when the toner discharging step determines that the amount of staying toner in the developing device is larger than a threshold that is the first reference or the second reference, and a discharge suspending step for suspending toner discharge by the toner discharging step depending on a result of determination by the subsequent job determining step.

19. A non-transitory computer-readable recording medium encoded with a program for controlling an image forming apparatus including a developing device for containing toner and performing development operation using toner, the program causing a computer to execute a process comprising:

a print performing step of performing printing using toner;

an image stabilization process performing step of performing an image stabilization process using toner;

an acquiring step of acquiring an amount of staying toner which is the difference between a standard amount of toner that should be consumed for an amount of development operation and an amount of toner that was actually consumed in the developing device; and a toner discharging step of discharging toner upon completion of printing, depending on the amount of staying toner acquired in the step of acquiring and a first reference and, upon completion of an image stabilization process, discharging toner depending on the amount of staying toner acquired in the step of acquiring and a second reference.

20. The non-transitory computer-readable recording medium according to claim 19, wherein the acquiring step acquires the amount of staying toner in the developing device by acquiring an amount of drive of a developer roller as the amount of development operation and a toner consumption for a print job.

21. The non-transitory computer-readable recording medium according to claim 19, wherein, upon completion of printing, the toner discharging step discharges toner depending on whether the amount of staying toner in the developing device acquired by the acquiring step is larger than a threshold that is the first reference or, upon completion of an image stabilization process, discharges toner depending on whether the amount of staying toner in the developing device acquired by the acquiring step is larger than a threshold that is the second reference.

22. The non-transitory computer-readable recording medium according to claim 19, wherein the acquiring step determines a difference between the standard amount of toner that should be consumed for an amount of drive of a developer roller as the amount of development operation and an amount of toner that has been actually consumed and acquires that difference as the amount of staying toner.

23. The non-transitory computer-readable recording medium according to claim 19, wherein the developing device includes a plurality of developing devices each containing toner of a different color, wherein the amount of staying toner in the developing device is managed for each of the plurality of developing devices.

24. A non-transitory computer-readable recording medium encoded with a program for controlling an image forming apparatus including a developing device for containing toner and performing development operation using toner, the program causing a computer to execute a process comprising a print performing step of performing printing using toner;

an image stabilization process performing step of performing an image stabilization process using toner;

an acquiring step of acquiring an amount of staying toner which is the difference between a standard amount of toner that should be consumed for an amount of development operation and an amount of toner that was actually consumed in the developing device;

a toner discharging step of discharging toner upon completion of printing, depending on the amount of staying toner acquired in the step of acquiring and a first reference or, upon completion of an image stabilization process, discharging toner depending on the amount of staying toner acquired in the step of acquiring and a second reference;

a determining step for determining an amount of toner to be consumed for a print job before the print job is performed, and a suspending step for suspending the print job depending on the amount of staying toner in the developing device acquired by the acquiring step and a result of determination by the determining step.

25. The non-transitory computer-readable recording medium according to claim 24, further comprising a controlling step for controlling an order of jobs to be performed such that a print job that the toner consumption is smaller than the toner consumption of a candidate job that is to be performed firstly in a plurality of print jobs is performed in preference to the candidate job, if the plurality of print jobs are registered and the amount of staying toner in the developing device becomes not more than zero by performing the candidate job, based on the amount of staying toner in the developing device acquired by the acquiring step and the amount of toner to be consumed for the candidate job.

26. The non-transitory computer-readable recording medium according to claim 24, further comprising a controlling step for controlling an order of jobs to be performed such that a print job that the toner consumption is larger than the toner consumption of a candidate job that is to be performed firstly in a plurality of print jobs is performed in preference to the candidate job, if the plurality of print jobs are registered and the amount of staying toner in the developing device becomes larger than a threshold that is the first reference by performing the candidate job, based on the amount of staying toner in the developing device acquired by the acquiring step and the amount of toner to be consumed for the candidate job.

27. A non-transitory computer-readable recording medium encoded with a program for controlling an image forming apparatus including a developing device for containing toner and performing development operation using toner, the program causing a computer to execute a process comprising a print performing step of performing printing using toner;

an image stabilization process performing step of performing an image stabilization process using toner;

an acquiring step of acquiring an amount of staying toner which is the difference between a standard amount of toner that should be consumed for an amount of development operation and an amount of toner that was actually consumed in the developing device;

a toner discharging step of discharging toner upon completion of printing, depending on the amount of staying toner acquired in the step of acquiring and a first reference or, upon completion of an image stabilization process, discharging toner depending on the amount of staying toner acquired in the step of acquiring and a second reference;

a subsequent job determining step for determining an amount of toner to be consumed for a subsequent print job when the toner discharging step determines that the amount of staying toner in the developing device is larger than a threshold that is the first reference or the second reference, and a discharge suspending step for suspending toner discharge by the toner discharging step depending on a result of determination by the subsequent job determining step.

* * * * *